US005673948A

United States Patent [19]

Karpisek

[11] Patent Number: 5,673,948

[45] Date of Patent: Oct. 7, 1997

[54] REMOTE LOCK OPERATION CONTROL MEANS

[76] Inventor: Ladislav Stephan Karpisek, 86 Woodfield Boulevarde, Caringbah N.S.W. 2229, Australia

[21] Appl. No.: 550,083

[22] Filed: Oct. 30, 1995

[30] Foreign Application Priority Data

Nov. 1, 1994 [AU] Australia ..... PM9203

[51] Int. Cl.[6] ..... E05C 1/06

[52] U.S. Cl. ..... 292/138; 292/37; 292/333

[58] Field of Search ..... 292/138, 142, 292/143, 144, 145, 333, 37

[56] References Cited

U.S. PATENT DOCUMENTS

| | | | |
|---|---|---|---|
| 4,579,376 | 4/1986 | Charlton | 292/144 |
| 4,656,850 | 4/1987 | Tabata | 292/144 X |
| 4,850,623 | 7/1989 | Franklin et al. | 292/144 |
| 5,009,456 | 4/1991 | Eck | 292/144 X |
| 5,029,912 | 7/1991 | Gotanda | 292/143 |
| 5,228,730 | 7/1993 | Gokcebay et al. | 292/144 |
| 5,246,258 | 9/1993 | Kerschenbaum et al. | 292/144 |
| 5,249,831 | 10/1993 | Maniaci | 292/144 |
| 5,280,881 | 1/1994 | Karmin | 292/144 X |
| 5,386,713 | 2/1995 | Wilson | 292/144 X |
| 5,531,086 | 7/1996 | Bryant | 292/142 X |

*Primary Examiner*—Rodney M. Lindsey
*Assistant Examiner*—Monica E. Millner
*Attorney, Agent, or Firm*—Edwin D. Schindler

[57] ABSTRACT

A door lock is disclosed having a slidable lock bolt with a latching device for releasably retaining the lock bolt in a position intermediate of extended and retracted positions for the lock bolt. The door lock may be used in combination with a remote lock operator and includes a retainer, which is slidably mounted in the lock bolt and which projects beyond the lock housing when the lock bolt is in the intermediate position, so as to be engaged with the remote lock operator and for holding the remote lock in its release condition. When the lock bolt moves to an extended position, the retainer will release the remote lock operator. There is a handle operated actuator rotatably mounted in the housing of the door lock. The actuator has two arms, respectively, to move the lock bolt from its extended to its intermediate position and, at the same time, to engage the remote lock operator for moving it to the remote lock release condition, where it can be engaged by the retainer.

9 Claims, 3 Drawing Sheets

REMOTE LOCK OPERATION CONTROL MEANS

BACKGROUND OF THE INVENTION

This invention relates to door locking arrangements for doors and in particular arrangements which incorporate a user operated primary lock which can interact with a remote lock or locks activated when the primary lock is activated.

In arrangements of the above type the primary lock is usually located about the mid-height of the door and one or more remote locks are located adjacent the top and/or bottom of the door. The remote lock(s) can use a lock bolt which moves in and out relative to the vertical edge of the door from which the primary lock bolt extends or from the top and/or bottom edge of the door. The arrangement provides multi-location locking of a door and is particularly favoured for doors which are potentially capable of twisting deformation, such as screen/security doors commonly in use.

The invention is directed to a primary door lock of the type in which the lock bolt of the door lock can have a fully extended condition, to lock a door closed, and an intermediate extended condition to latch a door closed and allow the door to be opened by retraction of the lock bolt. Where a remote lock or locks are associated with the primary door lock the remote lock is required to be held inoperative whilst the lock bolt of the primary door lock is operating between its retracted and intermediate extended conditions.

SUMMARY OF THE INVENTION

Generally stated, the invention can be said to provide a door lock including a housing, a lock bolt slidably mounted in the housing and movable between an extended position where it projects through a front edge of the housing and a retracted position where it lies at least substantially within the housing, first biassing means within the housing to urge said lock bolt towards its extended position, latching means to releasably retain the lock bolt in a position intermediate the lock bolt extended and retracted positions, a manually operable actuator mounted in the housing to slide the lock bolt in a retracting direction and move of a remote lock operator when associated with said door lock to a remote lock release position, an elongated position retainer for said operator, said retainer is slidably mounted on the lock bolt so as to be movable with said lock bolt and movable relative to said lock bolt in the direction of lock bolt movement, second biassing means to urge said retainer to an extended position where portion of the retainer extends beyond a rear end of the lock bolt, a first opening in a rear edge of said housing aligned with said retainer and through which said retainer can project to engage and retain a remote look operator in its remote lock release position, the length of said retainer is such that at a predetermined position in the extending movement of the lock bolt from its intermediate position to its extended position said retainer will be withdrawn sufficiently into said housing to preclude engagement between said retainer and an associated remote lock operator.

BRIEF DESCRIPTION OF THE DRAWING FIGURES

A preferred form of the invention will now be described with reference to the accompanying drawings in which:

FIG. 1 is a side view of portion of a lock according to the invention with a housing cover plate removed to show the lock bolt of the lock in an intermediate extended position, the lock is shown associated with an operator for a remote lock or locks, components of the lock not related to the invention are not shown, FIG. 2 is a view similar to FIG. 1 where the lock bolt is shown in the retracted position and the lock is shown associated with a striker plate on a door jamb and FIG. 3 is a view similar to FIG. 2 where the lock bolt is shown in the fully extended position in a recess in the door jamb aligned with the lock bolt aperture in the striker plate.

DETAILED DESCRIPTION OF THE DRAWING AND PREFERRED EMBODIMENT

Figure 1:
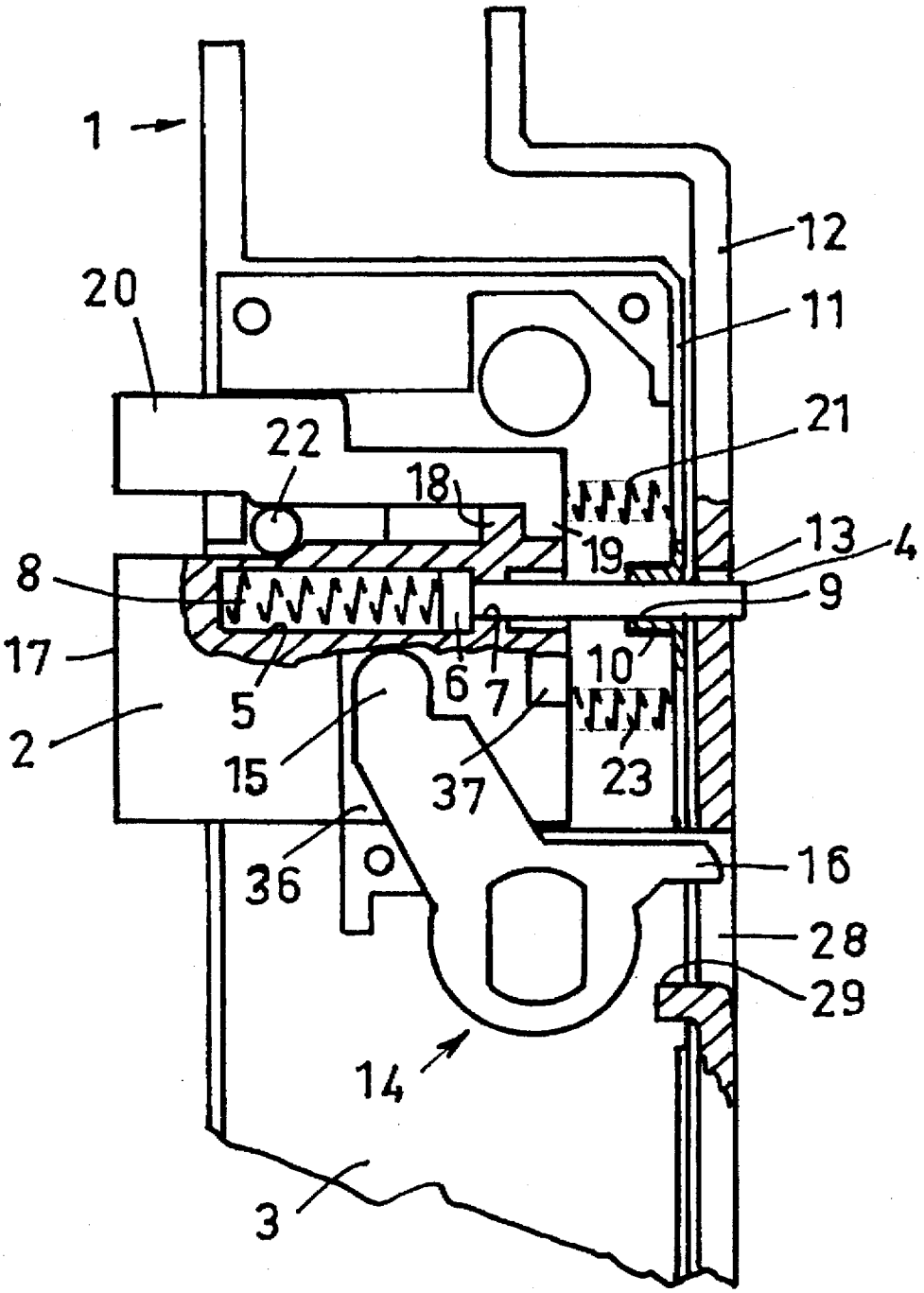

As illustrated the primary lock 1 includes a lock bolt 2 which has an intermediate extended position as shown in FIG. 1 where it extends a short distance from the lock housing 3. The lock bolt may be moved to a retracted position as shown in FIG. 2 and may adopt a fully extended position as shown in FIG. 3.

Figure 2:
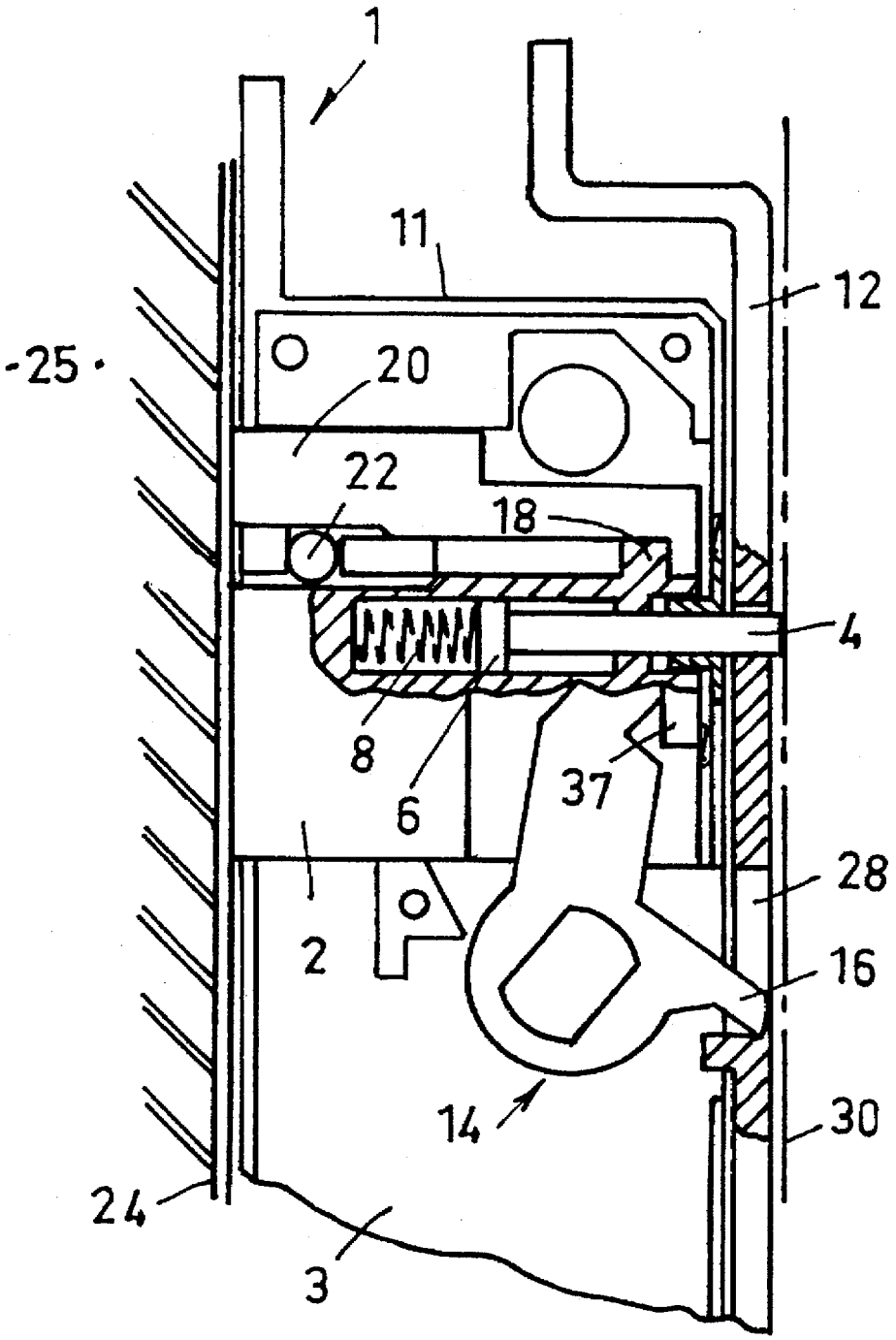
Figure 3:
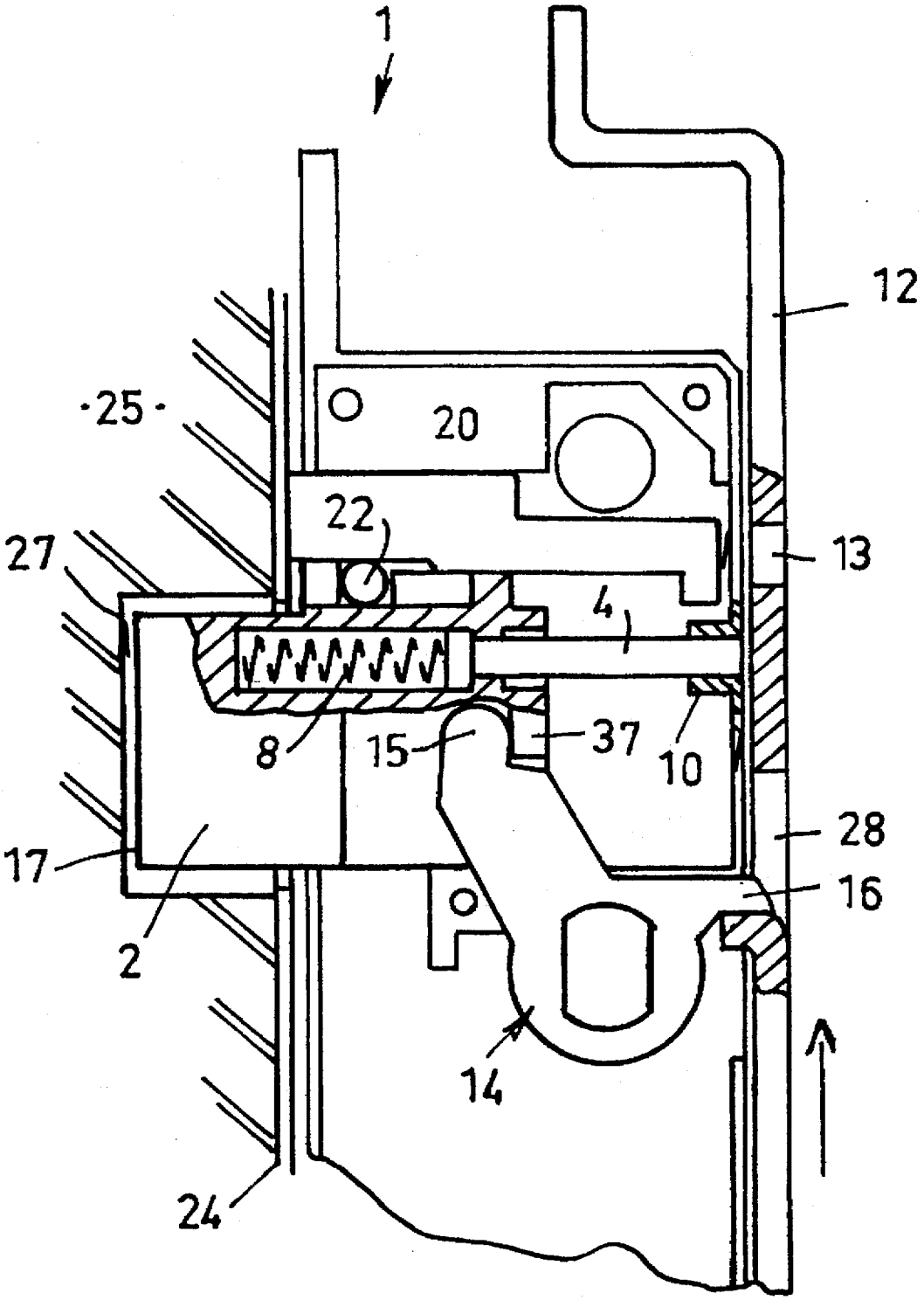

The lock bolt 2 is releasably held in the intermediate position by a latch means of suitable form which is:

(i) triggered when the door is closed allowing the lock bolt 2 to extend to the FIG. 3 and (ii) relatched when the lock bolt is withdrawn to the retracted position shown in FIG. 2 by means of a manual lock bolt actuator.

The latching means may be any one of several forms in commercial use and is designed to retain the lock bolt 2 in the FIG. 1 position against the action of the look bolt moving spring 23.

In the specific embodiment now described the lock bolt 2 includes a spring retainer pin 4 housed in a hole 5 in the lock bolt 2 and limited in its outward movement by a head 6 on the pin 4 abutting a shoulder 7 in the bore 5. The head 6 is urged against the shoulder 7 by a spring 8. The pin 4 extends from the rear end of the lock bolt 2 and is in permanent sliding engagement with the bore 9 of a bush 10 mounted on the rear edge 11 of the housing 3. The pin 4 is long enough to project a short distance beyond the housing wall 11 when the lock bolt 2 is in the intermediate position of FIG. 1. As will be seen the pin 4 will move with the lock bolt 2 and can move relative to the lock bolt 2.

There is a linearly movable remote lock operator 12 juxtaposed the rear wall 11 of the body 3 and external to the body 3. The operator 12 can be mounted in a number of way and can be mounted in guides on the lock housing. The operator 12 is spring biassed in the remote lock engaging direction indicated by the arrow S. There is a first slot 13 in the operator to receive the pin 4.

Rotatably mounted in the body 3 there is a handle controlled lock bolt actuator 14 which has a rest position as shown in FIG. 1, where the a first leg 15 of the actuator 14 bears on a stop 38. The leg 15 lies in a recess 36 in the lock bolt 2 provided with a shoulder 37 against which the leg 15 acts (as shown in FIG. 2) to retract the lock bolt 2. The actuator 14 has a second leg 16 which lies in the slot 28 in the operator 12.

In an operating sequence, the lock would be in the FIG. 1 rest position. The door with the lock fitted would then be closed and the striker plate 24 on the door jamb 25 (see FIG. 2) would be engaged by the lock bolt nose 17 and the lock bolt 2 would be forced back into the housing 3. The movement of the lock bolt 2, through the engagement of shoulder 18 on the lock bolt 2 and the shoulder 19 on a latch bolt 20, causes the latch bolt 20 to be retracted against the action of the spring 21. FIG. 2 shows the bolts 2 and 20 fully retracted.

The extension of the pin 4 beyond the operator 12 when the bolts are in the FIG. 2 position would normally be limited by engagement by the end of the pin 4 with the back wall 30 of the recess in the door for housing the lock, with corresponding compression of the spring 23. In security doors this would be the inner face of the extruded aluminium box section of the door frame member.

When the bolts are retracted, and with the lock bolt 20 held retracted by engagement with the striker plate 24, the lock bolt 2 is released from the latching element 22. During the closing of the door the lock bolt 2 (released from the effect of the latching element 22) will, when it comes into alignment with the striker plate aperture 26, pass therethrough and extend into recess 27 in the door jamb 25 aligned with the aperture 26 in the striker plate 24. The lock bolt 2 would then be in the fully extended FIG. 3 position with the latch lock bolt 20 still held retracted by end engagement with the striker plate 24.

It will be noted in the FIG. 3 that the pin 4 has been retracted from the slot 13 in the remote lock operator 12 and as a result the operator 12 has moved (under the influence of the spring acting on the operator) to the position shown in FIG. 3, and in so doing has caused the remote lock(s) to be activated. The door is now retained closed by engagement of the lock bolt 2 of the primary lock in the door jamb and one or more remote lock bolts engaged with the door jamb or the doorway head and/or the doorway sill. The abutment end 29 of the slot 28 now lies adjacent the actuator leg 16.

When the door is to be opened the actuator 14 is rotated manually and the leg 15 abutting the shoulder 37 causes the lock bolt 2 to retract. The leg 16 engages the abutment end 29 of the slot 28 and moves the operator 12 downwardly against the action of the associated spring. The end of the pin 4 will come to bear on the operator 12 before the slot 13 is aligned with the pin 4 so that as soon as the slot 13 is aligned with the pin 4 the pin will be fired into the slot 13 by the pin spring 8.

When the door has been opened the actuator 14 is released. The lock bolt 2 will advance simultaneously with the lock bolt 20 and, as will be seen from FIG. 1, the latch element 22 will now be in the latch position for the lock bolt 2. The lock is now positioned ready for reuse.

Changes can be made to some of the members described above in the preferred embodiment without departing from the inventive concept disclosed. For example, the housing of the pin 4 in a hole 5 in the lock bolt 2 is a preferred arrangement, but it would be possible to have a plate member slidably mounted on the side of the lock bolt 2 to function in the same manner as the pin 4.

As set out above, lock bolt latching means other than that described and illustrated can be used. It is also to be understood that the lock bolt 2 would normally be associated with a deadlock of known suitable type.

The bearing 10 is a preferred feature but with appropriate dimensioning it could be eliminated and the pin 4 could be supported directly in an opening in the rear wall of the housing.

In a further variation, the pin 4 could be supported by an elongated head 6 and so it could operated without reliance on a bearing 10 or a hole in the rear edge to position the outer end of the pin in the path of travel of the hole 13 in the operator 12.

I claim:

1. A door lock for use with a remote lock operator, said door lock comprising:

a housing;

a lock bolt slidably mounted in said housing and movable between an extended position wherein said lock bolt projects through a front edge of said housing and a retracted position, wherein said lock bolt lies at least substantially within said housing;

first biassing means within said housing for biassing said lock bolt toward said extended position;

latching means for releasably retaining said lock bolt in a position intermediate the extended position and the retracted position of said lock bolt;

a manually operable actuator rotatably mounted within said housing;

first arm means on said manually operable actuator;

second arm means on said manually operable actuator, said second arm means extending through an aperture in a rear edge of said housing and therebeyond for being engagable with a remote lock operator, wherein rotation of said manually operable actuator in a first direction causes said first arm means to engage and retract said lock bolt and said second arm means to engage and move the remote lock operator;

an elongated position retainer for the remote lock operator, said retainer being slidably mounted on said lock bolt so that said retainer is movable with said lock bolt and movable relative to said lock bolt in a direction of sliding movement by said lock bolt; and, second biassing means for biassing said retainer to an extended position wherein a portion of said retainer extends beyond a rear end of said lock bolt, an opening in the rear edge of said housing being aligned with said retainer and through which said retainer is protectable for engaging and retaining the remote lock operator in a remote lock release position, said retainer having a length so that it is capable of engaging and retaining the remote lock operator until said lock bolt attains a predetermined position in its extended movement beyond its intermediate position, at which position said retainer releases the remote lock operator.

2. The door lock according to claim 1, wherein said retainer is slidably mounted in a recess in said lock bolt and is biassed to its extended position by a spring housed in the recess.

3. The door lock according to claim 1, further comprising retainer guide means within said housing, with said retainer engaging said retainer guide means.

4. A door lock in combination with a remote lock operator, comprising:

a housing;

a lock bolt slidably mounted in said housing and movable between an extended position wherein said lock bolt projects through a front edge of said housing and a retracted position, wherein said lock bolt lies at least substantially within said housing;

first biassing means within said housing for biassing said lock bolt toward said extended position;

latching means for releasably retaining said lock bolt in a position intermediate the extended position and the retracted position of said lock bolt;

a manually operable actuator rotatably mounted within said housing;

a remote lock operator being slidably mounted relative to said housing and slidable in a direction at right angles in a direction of movement of said lock bolt, said remote lock operator having an abutment surface;

first arm means on said manually operable actuator;

second arm means on said manually operable actuator, said second arm means extending through an aperture in a rear edge of said housing and therebeyond for being engagable with said remote lock operator, wherein rotation of said manually operable actuator in a first direction causes said first arm means to engage and retract said lock bolt and said second arm means to engage and move said remote lock operator;

an elongated position retainer for said remote lock operator, said retainer being slidably mounted on said lock bolt so that said retainer is movable with said lock bolt and movable relative to said lock bolt in a direction of sliding movement by said lock bolt, said abutment surface of said remote lock operator being engagable by said retainer for retaining said remote lock operator in a remote lock release position; and, second biassing means for biassing said retainer to an extended position wherein a portion of said retainer extends beyond a rear end of said lock bolt, an opening in the rear edge of said housing being aligned with said retainer and through which said retainer is protectable for engaging and retaining said remote lock operator in said remote lock release position, said retainer having a length so that it is capable of engaging and retaining said remote lock operator until said lock bolt attains a predetermined position in its extended movement beyond its intermediate position, at which position said retainer releases said remote lock operator.

5. The door lock in combination with the remote lock operator according to claim 4, wherein said retainer is slidably mounted in a recess in said lock bolt and is biassed to its extended position by a spring housed in the recess.

6. The door lock in combination with the remote lock operator according to claim 4, further comprising retainer guide means within said housing, with said retainer engaging said retainer guide means.

7. The door lock in combination with the remote lock operator according to claim 4, wherein said remote lock operator includes an additional abutment surface and wherein said second arm means of said manually operable actuator is disposed in a spaced relationship with the additional abutment surface when said manually operable actuator is in a rest position, the spaced relationship of said second arm means and said additional abutment surface permitting said remote lock operator to move in a remote lock engaging position and thereby position said additional abutment surface adjacent said second arm means for engagement by said arm means on the first direction of rotation of said manually operable actuator.

8. The door lock in combination with the remote lock operator according to claim 7, wherein said abutment surface and said additional abutment surface are respectively sides of openings in said remote lock operator.

9. The door lock in combination with the remote lock operator according to claim 7, wherein said second arm means of said manually operable actuator extends into a slot in said remote lock operator and said additional abutment surface is an end of said slot.

* * * * *